US005317120A

United States Patent [19]

Bunke et al.

[11] Patent Number: 5,317,120

[45] Date of Patent: May 31, 1994

[54] MICROWAVE SUSCEPTOR PACKAGE HAVING AN APERTURED SPACER BETWEEN THE SUSCEPTOR AND THE FOOD PRODUCT

[75] Inventors: Paul R. Bunke; Robert L. Prosise, both of Cincinnati, Ohio

[73] Assignee: The Proctor & Gamble Company, Cincinnati, Ohio

[21] Appl. No.: 3,718

[22] Filed: Jan. 13, 1993

Related U.S. Application Data

[63] Continuation of Ser. No. 723,153, Jun. 28, 1991, abandoned.

[51] Int. Cl.[5] ..... H05B 6/64

[52] U.S. Cl. ..... 219/730; 219/759; 219/756; 99/DIG. 14; 426/107; 426/113; 426/234; 426/243

[58] Field of Search ..... 219/10.55 E, 10.55 F, 219/10.55 M, 10.41; 99/DIG. 14; 426/107, 113, 124, 126, 234, 243

[56] References Cited

U.S. PATENT DOCUMENTS

| | | | |
|---|---|---|---|
| 2,714,070 | 7/1955 | Welch | 426/234 |
| 2,830,162 | 4/1958 | Copson et al. | 219/10.41 |
| 3,271,169 | 9/1966 | Baker et al. | 426/107 |
| 3,835,280 | 9/1974 | Gades et al. | 219/10.55 |
| 3,946,188 | 3/1976 | Derby | 219/10.55 |
| 3,985,990 | 10/1976 | Levinson | 219/10.55 E |
| 4,064,305 | 12/1977 | Wallin | 428/246 |
| 4,122,324 | 10/1978 | Falk | 219/10.55 |
| 4,140,887 | 2/1979 | Sutton et al. | 219/10.55 |
| 4,144,435 | 3/1979 | Clark et al. | 219/10.55 |
| 4,190,757 | 2/1980 | Turpin et al. | 219/10.55 |
| 4,196,331 | 4/1980 | Leveckis et al. | 219/10.55 |
| 4,204,105 | 5/1980 | Leveckis et al. | 219/10.55 |
| 4,268,738 | 5/1981 | Flautt, Jr. et al. | 219/10.55 |

(List continued on next page.)

FOREIGN PATENT DOCUMENTS

| | | | |
|---|---|---|---|
| WO89/04585 | 5/1989 | European Pat. Off. | 219/10.55 E |

OTHER PUBLICATIONS

Co-pending assigned U.S. Pat. Application of M. D. McCutchan et al., Ser. No. 437,001, filed on Nov. 15, 1989, entitled "A Method of Simultaneously Microwave Heating or Baking Plural Articles, and Concomitant Package", (no copy supplied).

Co-pending commonly assigned U.S. Patent Application of Robert L. Prosise and Paul R. Bunke, Ser. No. 458,924, filed on Dec. 29, 1989, entitled "Microwave Food Package".

*Primary Examiner*—Bruce A. Reynolds
*Assistant Examiner*—Tu Hoang
*Attorney, Agent, or Firm*—Michael E. Hilton; E. Kelly Linman

[57] ABSTRACT

A single use combined shipping display and cooking microwave package is provided for heating a plurality of food pieces in a microwave oven. The packaging includes a microwave transparent enclosure which has a top panel and a bottom panel. Located adjacent to and generally coextensive with the bottom panel is a microwave susceptor. Preferably this microwave susceptor is a thin film susceptor. A spacer overlays the thin film susceptor and is also generally coextensive with the bottom panel. The spacer is adapted to hold the food pieces a predetermined distance away from this susceptor. In addition, the spacer has a plurality of apertures therein which allows the heat from the microwave susceptor to pass through to the food pieces. A similar arrangement is applicable to the top panel. A top panel microwave susceptor is located adjacent to and generally coextensive with the top panel and a top panel spacer is located adjacent to the top panel susceptor and generally coextensive with the top panel. The food pieces are held in a cavity located between the top panel spacer and the bottom panel spacer. An exemplary package is provided which is particularly well suited for roasting nuts in a microwave oven.

20 Claims, 4 Drawing Sheets

U.S. PATENT DOCUMENTS 4,283,427 8/1981 Winters et al. ..... 426/107
4,351,997 9/1982 Mattisson et al. ..... 219/10.55
4,505,391 3/1985 Kuchenbecker ..... 206/622
4,518,651 5/1985 Wolfe, Jr. ..... 428/308.8
4,590,349 5/1986 Brown et al. ..... 219/10.55
4,594,492 6/1986 Maroszek ..... 219/10.55
4,641,005 2/1987 Seiferth ..... 219/10.55
4,642,434 2/1987 Cox et al. ..... 219/10.55 E
4,662,969 5/1987 Wang et al. ..... 156/253
4,703,148 10/1987 Mikulski et al. ..... 219/10.55
4,713,510 12/1987 Quick et al. ..... 219/10.55
4,740,377 4/1988 Dawes et al. ..... 426/234
4,745,249 5/1988 Daniels ..... 219/10.55 E
4,777,053 10/1988 Tobelmann et al. ..... 426/107
4,785,160 11/1988 Hart ..... 219/10.55
4,825,025 4/1989 Seiferth ..... 219/10.55
4,835,352 5/1989 Sasaki et al. ..... 219/10.55
4,836,383 6/1989 Gordon et al. ..... 206/611
4,857,342 8/1989 Kappes ..... 426/107
4,864,089 9/1989 Tighe et al. ..... 219/10.55
4,870,233 9/1989 McDonald et al. ..... 219/10.55
4,871,892 10/1989 Samford ..... 219/10.55
4,877,933 10/1989 Yangas ..... 219/10.55
4,891,482 1/1990 Jaeger et al. ..... 219/10.55
4,896,009 1/1990 Pawlowski ..... 219/10.55
4,906,806 3/1990 Levinson ..... 219/10.55
4,916,280 4/1990 Havette ..... 219/10.55
4,922,071 5/1990 Samford ..... 219/10.55
4,923,704 5/1990 Levinson ..... 426/243
4,924,048 5/1990 Bunce et al. ..... 219/10.55
4,935,592 6/1990 Oppenheimer ..... 219/10.55 E
4,941,401 7/1990 Sarnoff et al. ..... 99/446
4,942,277 7/1990 Narberes ..... 219/10.55
4,943,439 7/1990 Andreas et al. ..... 426/107
4,948,932 8/1990 Clough ..... 219/10.55
4,972,058 11/1990 Benson et al. ..... 219/10.55 E
4,972,059 11/1990 Wendt et al. ..... 219/10.55 E
5,041,295 8/1991 Perry et al. ..... 426/107
5,049,710 9/1991 Prosise et al. ..... 219/10.55 E
5,077,455 12/1991 Peleg et al. ..... 219/10.55 E

MICROWAVE SUSCEPTOR PACKAGE HAVING AN APERTURED SPACER BETWEEN THE SUSCEPTOR AND THE FOOD PRODUCT

This is a continuation of application Ser. No. 07/723,153, filed on Jun. 28, 1991, now abandoned.

BACKGROUND OF THE INVENTION

1. Field of the Invention

The present invention relates to microwave packages, and more particularly, to such packages including microwave susceptors for providing conduction heating to the contents thereof.

2. Description of the Prior Art

Microwave ovens possess the ability to heat, cook or bake certain items, particularly food stuffs, extremely rapidly. Unfortunately, microwave heating also has its disadvantages. For example, microwave heating alone in today's microwave ovens often fails to achieve such desirable results as browning and crispening. Contemporary approaches to achieving these and other desirable results with microwave ovens include the use of microwave susceptors.

Generically, microwave susceptors are devices which when disposed in a microwave energy field such as exists in a microwave oven, respond by generating a significant amount of heat. The susceptor absorbs a portion of the microwave energy and converts it directly to heat which is useful, for example, to crispen or brown food stuffs. Although several mechanisms can be responsible for a microwave susceptor's ability to convert microwave energy directly to heat, the most commercially successful microwave susceptors to date are so-called thin filmed susceptors which rely on resistive, i.e., $I^2R$, losses to generate heat. These thin film susceptors generally consist of a plastic sheet which has a thin layer of conductive or semiconductive metal coated thereon.

The prior art consists of a myriad of microwave packages which utilize microwave susceptors. For example, U.S. Pat. No. 4,891,482 issued to Jaeger et al. on Jan. 2, 1990 discloses a package which includes a sleeve which has a microwave susceptor located thereon. During cooking in the microwave the food product is surrounded by the microwave susceptor and the susceptor is adapted to provide increased heat at the lower surface of the food product.

U.S. Pat. No. 4,777,053 issued on Oct. 11, 1988 to Tobelmann et al. discloses a package which has upper and lower microwave susceptors located in contact with opposing sides of the food to be heated. The susceptors are spaced from external shield layers by a corrugated layer.

U.S. Pat. No. 4,713,510 issued to Quick et al. on Dec. 15, 1987 discloses a package incorporating a susceptor layer adjacent a solid paperboard layer in contact with the food to be heated.

SUMMARY OF THE INVENTION

In accordance with one aspect of the present invention a single-use, combined shipping, display and cooking microwave package is provided for heating a food product. This package includes a microwave transparent outer enclosure having a bottom panel. A bottom panel microwave susceptor is located adjacent the bottom panel and generally coextensive with the bottom panel. Also included is a bottom panel spacer located adjacent the bottom panel susceptor and generally coextensive with the bottom panel. The bottom panel spacer is adapted to support the food product in a food product cavity located a predetermined distance away from the bottom susceptor. In addition, the bottom panel spacer has a plurality of apertures which are adapted to pass substantially all of the heat from the bottom susceptor through the bottom panel spacer to the food product in the food product cavity.

In accordance with another aspect of the present invention a single-use, combined shipping, display and cooking microwave package for heating a plurality of food pieces in a microwave oven is provided. This package includes a microwave transparent outer enclosure which has a bottom panel and a top panel. A bottom panel microwave susceptor is located adjacent the bottom panel and is generally coextensive with the bottom panel. A bottom panel spacer is located adjacent the bottom panel microwave susceptor and is generally coextensive with the bottom panel. The bottom panel spacer is adapted to support the plurality of food pieces in a food product cavity located a first predetermined distance away from the bottom panel susceptor. In addition, the bottom panel spacer has a plurality of apertures which are adapted to pass substantially all the heat from the bottom panel susceptor through the bottom panel spacer to the plurality of food pieces in the food product cavity. A top panel microwave susceptor is located adjacent the top panel and is generally coextensive with the top panel. A top panel spacer is located adjacent the top panel susceptor and generally coextensive with the top panel. The top panel spacer is adapted to support the plurality of food pieces in a food product cavity a second predetermined distance away from the top panel susceptor. (This second predetermined distance may be the same numerical value as the first predetermined distance, above.) In addition, the top panel spacer has a plurality of apertures which are adapted to pass substantially all of the heat from the top panel susceptor through the top panel spacer to the plurality of food pieces in the food product cavity.

In accordance with a further aspect of the present invention, a single use combined shipping display and cooking microwave package for heating a plurality of edible nuts in a microwave oven is provided. This package includes a microwave transparent outer enclosure made of cellulose material which has a bottom panel and a top panel. A bottom panel microwave susceptor is located adjacent the bottom panel and is generally coextensive with the bottom panel. A bottom panel spacer is located adjacent to the bottom panel microwave susceptor and is generally coextensive with the bottom panel. The bottom panel spacer is adapted to support the plurality of edible nuts in a nut cavity located a first predetermined distance away from the bottom panel susceptor from about 0.05 inch to about 0.35 inch. In addition, the bottom panel spacer has a plurality of apertures which are adapted to pass substantially all the heat from the bottom panel susceptor through the bottom panel spacer to the plurality of edible nuts. A top panel microwave susceptor is located adjacent to top panel and is generally coextensive with the top panel. A top panel spacer is located adjacent to the top panel susceptor and generally coextensive with the top panel. The top panel spacer is adapted to support the plurality of edible nuts in a nut cavity located a second predetermined distance away from the top panel susceptor. In addition, the top panel susceptor has a plurality of apertures which are adapted to pass substantially all of the heat from the top panel susceptor through the top panel spacer to the plurality of edible nuts. The height of the nut cavity is from about 0.25 inch to about 0.75 inch.

BRIEF DESCRIPTION OF THE DRAWINGS

While the specification concludes with claims which particularly point out and distinctly claim the invention, it is believed the present invention will be better understood from the following description of a preferred embodiment taken in conjunction with the accompanying drawings, in which like reference numerals identify identical elements and wherein;

DESCRIPTION OF THE PREFERRED EMBODIMENT

Figure 1:
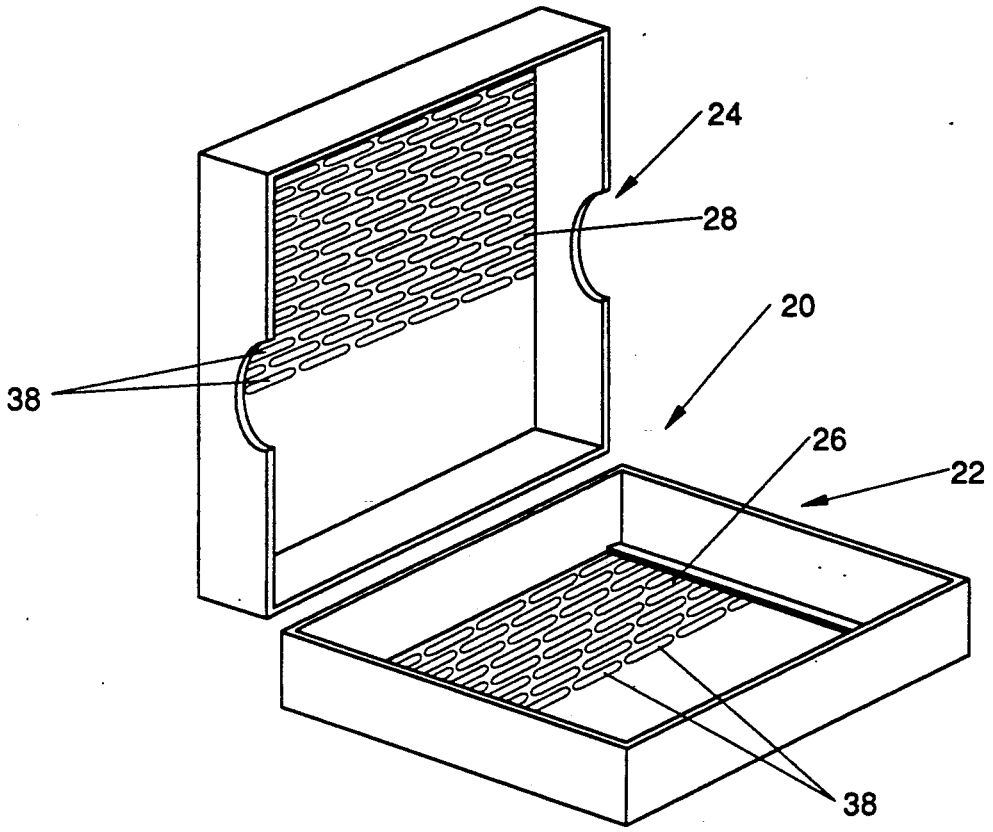
FIG. 1 is an isometric view of a particularly preferred embodiment of the microwave package of the present invention in an open orientation and without food product therein.
Figure 2:
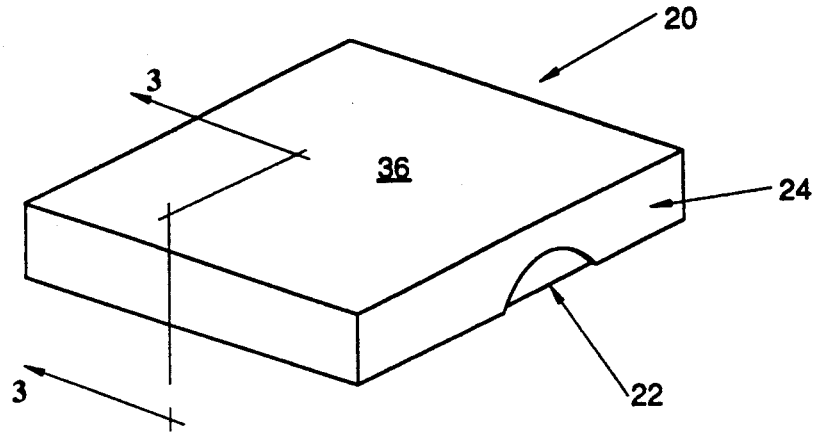
FIG. 2 is an isometric view of the package of FIG. 1 in a closed orientation and with food product therein.
Figure 3:
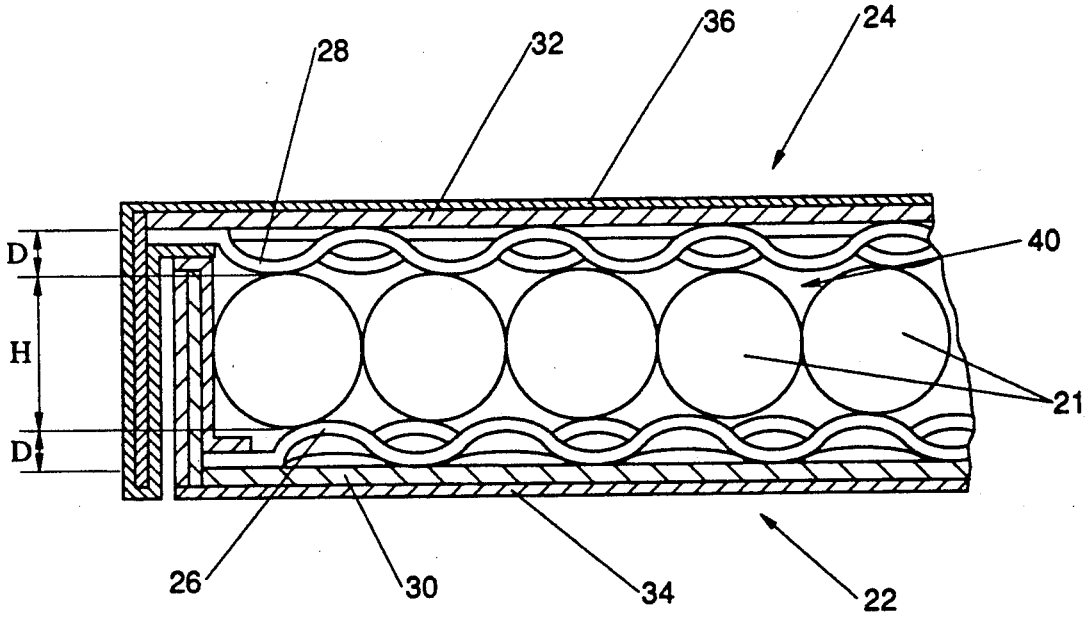
FIG. 3 is an enlarged fragmentary cross-sectional view taken along line 3—3 of FIG. 2.

In a particularly preferred embodiment illustrated in FIGS. 1–3, the present invention provides a single-use, shipping, display and cooking microwave package (indicated generally as 20) for heating a food product 21. Basically, package 20 includes a base 22 and a cover 24 which combine to form an outer enclosure. Located inside the enclosure are spacers 26 and 28 which maintain the food product 21 a predetermined distance "D" away from microwave susceptors 30 and 32. Although base 22 and cover 24 are shown in the drawings as two completely separate components, many alternative arrangements are possible. For example, base 22 and cover 24 could be hingedly connected to each other.

The outer enclosure formed by base 22 and cover 24 is made of a substantially microwave transparent material. References to the outer enclosure being microwave transparent are intended merely to indicate that the outer surface does not include a substance which is microwave interactive. However, the inner surface or even an intermediate portion or layer of this material may include a microwave interactive material. The microwave transparent material is preferably inexpensive such that the package is readily disposable. Exemplary preferred microwave transparent materials are plastic, ceramic and cellulosic materials, with cellulosic materials, such as paperboard or carton board being more preferred. For reasons such as low cost and ready disposability, paperboard is the most preferred microwave transparent material.

Referring to FIG. 3, the outer enclosure created by base 22 and cover 24 includes a bottom panel 34 and a top panel 36. Although the term bottom panel and the term top panel are used throughout, these terms are only intended to refer to any pair of opposing walls and is not intended to require any particular orientation.

Adjacent bottom panel 34 and generally coextensive with bottom panel 34 is a bottom panel microwave susceptor 30 for producing heat inside the package 20. Bottom panel susceptor 30 may be integral with the bottom panel 34, attached to adjacent bottom panel 34 as by adhesive, or merely held adjacent bottom panel 34. Likewise, a top panel microwave susceptor 32 is located adjacent top panel 36 and generally coextensive therewith.

Susceptors 30 and 32 can be virtually any type of microwave susceptor, such as microwave active coating materials consisting of metallic particles in a dielectric matrix, or the more traditional thin film susceptors. Examples of microwave active coating materials including conductive or semi-conductive particles in a dielectric matrix are disclosed in U.S. Pat. No. 4,864,089 issued to Tighe et al. on Sep. 5, 1989, the disclosure of which is hereby incorporated herein by reference. However, thin film susceptors, i.e, usually a polyester sheet having a thin layer of conductive or semi-conductive metal coated thereon, are preferred. An exemplary thin film susceptor is disclosed in U.S. Pat. No. 4,641,005 issued to Seiferth on Feb. 3, 1987, the disclosure of which is hereby incorporated herein by reference.

Located adjacent bottom panel susceptor 30 is a bottom panel spacer 26 which is generally coextensive with bottom panel 34. Similarly, a top panel spacer 28 is located adjacent top panel susceptor 32 and generally coextensive with top panel 36. Spacers 26 and 28 are adapted to prevent contact between susceptors 30 and 32 and food product 21 by supporting food product 21 a predetermined distance "D" away from susceptors 30 and 32, respectively. A plurality of apertures 38 are provided in each spacer 26 and 28 which are adapted to pass substantially all of the heat through to food product 21 in the food product cavity 40 from the adjacent susceptors 30 and 32, respectively.

Thus, apertures 38 of spacers 26 and 28 allow direct convective and radiant heat transfer from susceptors 30 and 32 to food product 21. Without apertures 38, the heat would be transferred to spacer 26 or 28 and then to the food product 21. This type of heat transfer, i.e., conductive, can facilitate localized areas of burning. In addition, the heated air which provides the convective heat transfer, is able to disperse somewhat in the food product cavity 40 which provides significantly more even heating.

The predetermined distance "D" is large enough that the heat energy from susceptors 30 and 32 is more evenly distributed to the food product 21 through convective and radiant heat transfer, eliminating areas of burning. On the other hand, the predetermined distance "D" is small enough to ensure adequate heat transfer from susceptors 30 and 32 to the food product 21. Preferably, this predetermined distance "D" which spacers 26 and 28 hold the food product 21 away from susceptors 30 and 32 is from about 0.05 inch to about 0.35 inch and more preferably, from about 0.10 inch to about 0.35 inch.

Figure 4:
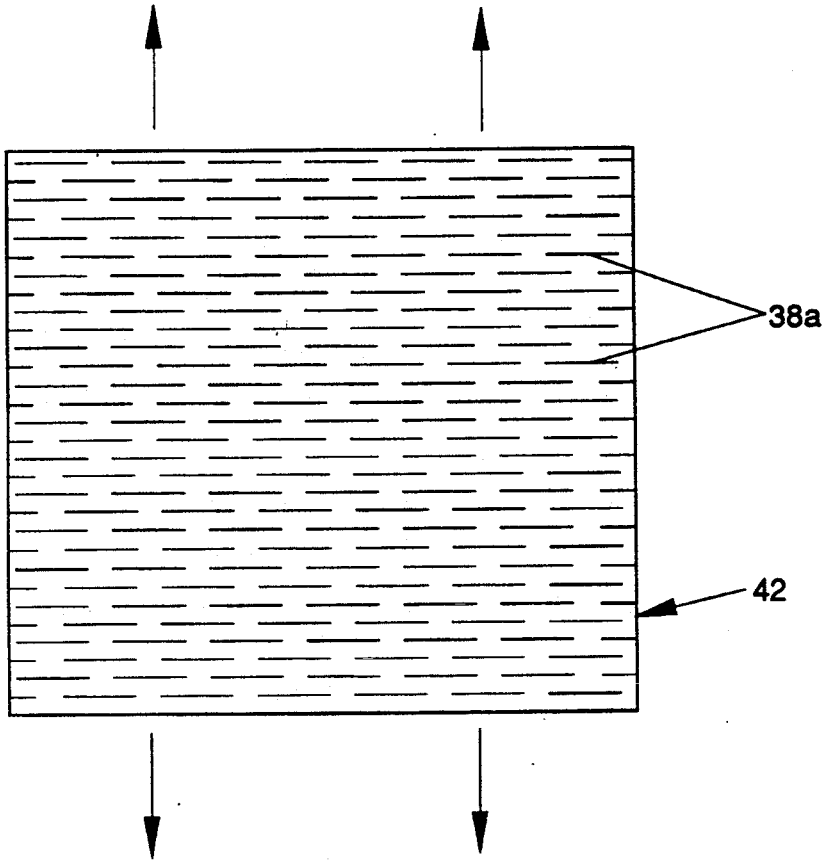
FIG. 4 is a top plan view of a blank which may be used to form the spacers of the package of FIG. 1.
Figure 5:
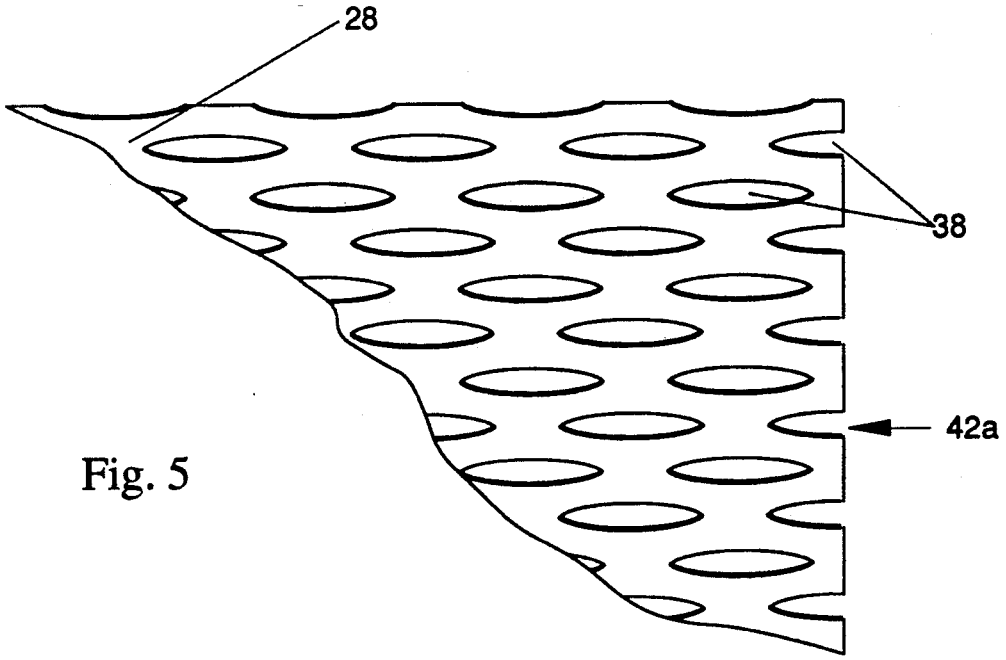
FIG. 5 is a fragmentary top plan view of a portion of the blank of FIG. 4 after having been expanded into a spacer.

Spacers 26 and 28 are preferably microwave transparent, and more preferably, made of cellulosic material such as paperboard or carton board. Spacers 26 and 28 of this preferred embodiment are expanded paperboard grates. Illustrated in FIG. 4 is a blank, indicated generally as 42, which may be utilized to form spacers 26 and 28 or expanded paperboard grates. Blank 42 is a sheet of paperboard which has a plurality of alternating offset rows of slits 38*a* cut therethrough. Slits 38*a* can be made in any appropriate manner. Slits 38*a*, however, are preferably made using a rotary or stamp die. Once slits 38a are made in the paperboard sheet, blank 42 is then placed under tension in the direction shown by the arrows of FIG. 4 until a paperboard grate having the appropriate thickness is formed. This operation transforms blank 42 of FIG. 4 into expanded paperboard grate 42a illustrated in FIG. 5. This expanded paperboard grate 42a may serve as one of spacers 26 and 28.

A food product cavity 40 is formed in this preferred embodiment between bottom panel spacer 26 and top panel spacer 28. In an alternative embodiment, where top panel susceptor 32 and top panel spacer 28 are absent, the food product cavity 40 extends between bottom panel spacer 26 and top panel 36. In a second alternative embodiment, wherein multiple layers of food product are separated by intermediate susceptors and spacers the food product cavities are between each pair of opposing spacers. In any event, the food product cavity 40 is the open space within the enclosure adapted to house the food product 21.

The height "H" of the food product cavity 40 is preferably less than twice the thickness of the food product 21. In the case of a plurality of food product pieces, this height "H" assures that the food product pieces remain in one layer and do not significantly overlay each other. More, preferably the height "H" of the food product cavity 40 is such that the plurality of food pieces are held closely between spacers 26 and 28 to minimize movement of the food product 21. For food products 21, such as nuts, having an average height of from about ⅜ inch to about ½ inch that food cavity heights "H" from about ½ inch to about ¾ inch are preferred, and a food cavity height "H" of about 9/16 inch is most preferred.

Figure 6:
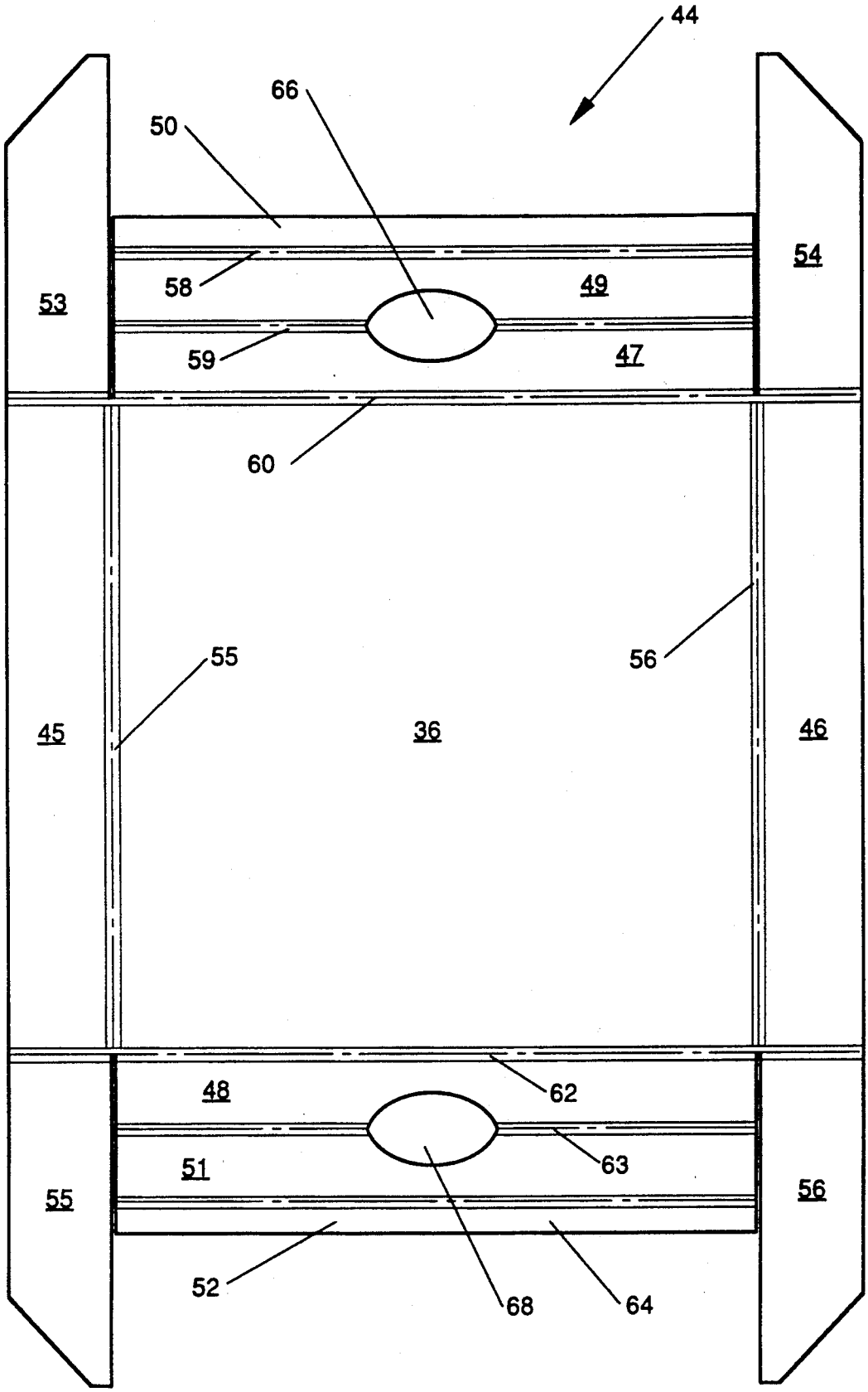
FIG. 6 is a top plan view of a blank which may be used to form the cover of the package of FIG. 1.

Referring to FIG. 6, a paperboard blank 44 is illustrated from which the cover 24 of FIG. 1 can be formed. Blank 44 includes a top panel 36, two side panels 45 and 46, two end panels, 47 and 48, two pairs of end panel extensions 49, 50, 51 and 52, and four end flaps 53, 54, 55 and 56. These panels are delineated by longitudinal score lines 55 and 56, and transverse score lines 58, 59, 60, 62, 63 and 64. The blank 44 also includes two apertures 66 and 68.

To form blank 44 of FIG. 6 into cover 24 of FIG. 1, top panel microwave susceptor 32 is placed adjacent top panel 36 and generally coextensive therewith, as seen in FIG. 3. Top panel spacer 28 is then placed over the microwave susceptor 32, coextensive with both susceptor 32 and top panel 36. Side panel 45 is folded 90° along score line 55 and side panel 46 is folded along score line 56. End flaps 53 and 54 are folded 90° along score line 60 and end flaps 53 and 54 are folded 90° along score line 62.

End panel 47 is folded 90° along score line 60 and end panel 47 is folded 90° along score line 62. Inner end panel extension 49 is folded 90° along score line 59 around the end flaps 53 and 54. Adhesive located on both sides of the end flaps 53 and 54 operate to attach the end flaps 53 and 54 to the end panel 47 and the inner end panel extension 49. Outer end panel extension 50 is folded outwardly by this operation, forming a ledge which acts to hold spacer 28 adjacent to susceptor 32. In turn, spacer 28 holds susceptor 32 adjacent to top panel 36. An identical operation is used to form the other end, employing end panel 48 and end panel extensions 51 and 52.

A similar blank may used to make base 22 of the preferred embodiment. The dimensions of the blank for base 22 are slightly smaller, such that formed base 22 may be telescoped into cover 24. In addition, apertures 66 and 68 are not necessary since the grasping points they provide are not relevant to base 22. Otherwise, the blank and the forming process for base 22 is identical to those described above with regard to cover 24.

Package 20 is preferably specifically adapted to roast nuts, and more preferably, cashew nuts. Furthermore, package 20 is preferably sized to contain a single serving of food product 21, although any serving size may be contained therein. Since package 20 is a combined shipping, display, cooking and serving package 20, a plastic over wrap (not shown) may be provided during the shipping and display periods to assure freshness of the food product 21 contained therein. This over wrap is then removed prior to cooking the food product 21 in a microwave.

An example of a package 20 which is specifically adapted to roast a single serving of about 85 grams of cashew nuts could have overall dimensions of about 4.5 inches in length, about 4.5 inches in width and about ⅞ inch in height. The height "H" of the food cavity 40 is about 9/16 inch and the predetermined distance "D" which spacers 26 and 28 hold the food product 21 away from susceptors 30 and 32 is about ⅛ inch. Spacers 26 and 28 could be formed using a stamp die which creates slits about 7/16 inch long, offset fifty percent and spaced apart both laterally and axially about ⅛ inch. Susceptors 30 and 32 could be thin film susceptors which have a thin paper backing. Such susceptors may be purchased from Leigh Mardon Pty., Limited, of Mascot, Australia under the trade name MICROCRISP®. The outer enclosure and spacers 26 and 28 could be made of a 22 point paperboard which is clay coated on one side and FDA approved for direct food contact.

The cashew nuts are preferably raw, although "raw" cashew nuts are generally subjected to heating to the extent necessary to drive off the black, acrid, caustic oil of the middle layer of the shell. The cashew nuts also are preferably coated with a flavor coating. One exemplary flavor coating consists of the following ingredients in the following weight percentages:

| | |
|---|---|
| Water | 30% |
| Sorbitol | 50% |
| Dextrin (NADEX 419) | 6% |
| Dextrin (NADEX 772) | 14% |

The dextrin's may be purchased from National Starch and Chemical Corporation, Bridgewater, N.J. utilizing the trade names and numbers in the above parenthesis (i.e., NADEX 19 and NADEX 772).

After the coating is mixed for approximately thirty minutes it is applied to the nuts in a panning operation. A typical panning operation involves placing the nuts into a rotating drum where the coating is slowly added until the nuts are uniformly coated. Then salt or other seasoning may be added to the rotating drum. The panning operation could include 100 grams of cashew nuts, 2 grams of coating material and 1.2 grams of salt. Alternatively, the panning operation could include 100 grams of nuts, 2 grams of the coating material and 2 grams of a Honey Nut seasoning which may be purchased from Baltimore Spice, Co., Baltimore, Md.

The coating can then be dried by placing the coated nuts into a convection oven such as a 1500 watt Turbo Convection Oven manufactured by Farberware, Bronx, N.Y. for twenty minutes at 250° F. After this drying operation the nuts are still "raw" as they have not been subjected to the high temperatures necessary for roasting.

The previously described exemplary package 20 may then be filled with about 85 grams of these nuts. The package 20 containing nuts can then be place inside a microwave oven for roasting. The microwave oven could be a GE Spacemaker II, model J-EM8244-001, which delivers about 550–600 watts. Utilizing this model microwave oven a total cooking time of two minutes; broken into four 30 second intervals allowing for three one-quarter turns between the intervals would provide good results. It is expected that the aroma of fresh roasted nuts will emanate from the microwave.

Although particular embodiments of the present invention have been shown and described, modification may be made to the package without departing from the teachings of the present invention. Accordingly, the present invention comprises all embodiments within the scope of the appended claims.

What we claim is:

1. A single-use, combined shipping, display and cooking microwave package for heating a food product in a microwave oven, the package comprising:

(a) a microwave transparent outer enclosure having a bottom panel;

(b) a bottom panel microwave susceptor located adjacent the bottom panel; and (c) a bottom panel spacer located adjacent the bottom panel microwave susceptor, between the bottom panel microwave susceptor and the food product, the bottom panel spacer being adapted to support the food product in a food product cavity located a predetermined distance away from the bottom panel microwave susceptor and having a plurality of apertures sized to pass substantially all of the heat from the bottom panel microwave susceptor through the bottom panel spacer to the food product.

2. A single-use, combined shipping, display and cooking microwave package according to claim 1 wherein the bottom panel microwave susceptor, bottom panel spacer and the bottom panel are all generally coextensive.

3. A single-use, combined shipping, display and cooking microwave package according to claim 1 wherein the bottom panel spacer is a paperboard grate.

4. A single-use, combined shipping, display and cooking microwave package according to claim 1 wherein the predetermined distance is from about 0.05 inch to about 0.35 inch.

5. A single use, combined shipping, display and cooking microwave package according to claim 1 wherein the predetermined distance is from about 0.10 inch to about 0.35 inch.

6. A single-use, combined shipping, display and cooking microwave package according to claim 1 wherein the food product has a vertical thickness and the food product cavity has a vertical height less than about twice the vertical thickness of the food product.

7. A single-use, combined shipping, display and cooking microwave package for heating a plurality of food pieces in a microwave oven, the package comprising:

(a) a microwave transparent outer enclosure having a bottom panel and a top panel;

(b) a bottom panel microwave susceptor located adjacent the bottom panel;

(c) a bottom panel spacer adjacent the bottom panel microwave susceptor, between the bottom panel microwave susceptor and the food pieces, the bottom panel spacer being adapted to support the plurality of food pieces in a cavity located a first predetermined distance away from the bottom panel microwave susceptor and having a plurality of apertures for passing substantially all of the heat from the bottom panel microwave susceptor through the bottom panel spacer to the plurality of food pieces;

(d) a top panel microwave susceptor located adjacent the top panel; and (e) a top panel spacer located adjacent the top panel microwave susceptor, between the top panel microwave susceptor and the food pieces, the top panel susceptor being adapted to support the plurality of food pieces in a cavity located a second predetermined distance away from the top panel susceptor and having apertures sized to pass substantially all of the heat from the top panel microwave susceptor directly through the top panel spacer to the plurality of food pieces.

8. A single-use, combined shipping, display and cooking microwave package according to claim 7 wherein the bottom panel microwave susceptor, bottom panel spacer and bottom panel are all generally coextensive.

9. A single-use, combined shipping, display and cooking microwave package according to claim 7 wherein the top panel microwave susceptor, top panel spacer and top panel are all generally coextensive.

10. A single-use, combined shipping, display and cooking microwave package according to claim 8 wherein the top panel microwave susceptor, top panel spacer and top panel are all generally coextensive.

11. A single-use, combined shipping, display and cooking microwave package according to claim 7 wherein the bottom panel spacer and the top panel spacer are paperboard grates.

12. A single-use, combined shipping, display and cooking microwave package according to claim 10 wherein the bottom panel spacer and the top panel spacer are paperboard grates.

13. A single-use, combined shipping, display and cooking microwave package according to claim 7 wherein the first and the second predetermined distances are from about 0.05 inch to about 0.35 inch.

14. A single-use, combined shipping, display and cooking microwave package according to claim 12 wherein the first and the second predetermined distances are from about 0.05 inch to about 0.35 inch.

15. A single-use, combined shipping, display and cooking microwave package according to claim 7 wherein the first and the second predetermined distances are from about 0.10 inch to about 0.35 inch.

16. A single-use, combined shipping, display and cooking microwave package according to claim 12 wherein the first and the second predetermined distances are from about 0.10 inch to about 0.35 inch.

17. A single-use, combined shipping, display and cooking microwave package according to claim 7 wherein the cavity has a vertical height dimensioned such that the plurality of food pieces are held substantially in place.

18. A single-use, combined shipping, display and cooking microwave package according to claim 14 wherein the height of the cavity has a vertical height dimensioned such that the plurality of food pieces are held substantially in place.

19. A single-use, combined shipping, display and cooking microwave package for heating a plurality of edible nuts in a microwave oven, the package comprising:

(a) a microwave transparent outer enclosure made of cellulosic material and having a bottom panel and a top panel;

(b) a bottom panel microwave susceptor located adjacent the bottom panel and generally coextensive with the bottom panel;

(c) a bottom panel spacer located adjacent the bottom panel microwave susceptor, between the bottom panel microwave susceptor and the plurality of edible nuts and generally coextensive with the bottom panel, the bottom panel spacer being adapted to support the plurality of edible nuts in a nut cavity located a first predetermined distance away from the bottom panel susceptor of from about 0.5 inch to about 0.35 inch and having apertures sized to pass substantially all of the heat from the bottom panel microwave susceptor through the bottom panel spacer to the plurality of edible nuts;

(d) a top panel microwave susceptor located adjacent the top panel and generally coextensive with the top panel; and (e) a top panel spacer located adjacent the top panel microwave susceptor, between the top panel microwave susceptor and the plurality of edible nuts and generally coextensive with the top panel susceptor, the top panel spacer being adapted to support the plurality of edible nuts in a nut cavity located a second predetermined distance away from the top panel susceptor and having apertures sized to pass substantially all of the heat from the top panel microwave susceptor through the top panel spacer to the plurality of edible nuts; the height of the nut cavity is from about 0.25 inch to about 0.75 inch.

20. A single-use, combined shipping, display and cooking microwave package according to claim 19 wherein the first and the second predetermined distances are from about 0.10 inch to about 0.35 inch.

* * * * *